US005458179A

United States Patent [19]

Magaldi et al.

[11] Patent Number: 5,458,179

[45] Date of Patent: Oct. 17, 1995

[54] INTERLOCKING SHUTTER CURTAIN ASSEMBLY

[76] Inventors: Glen Magaldi; Gregory Weeks, both of 3600 23 Ave. South, Lake Worth, Fla. 33461

[21] Appl. No.: 298,216

[22] Filed: Aug. 29, 1994

[51] Int. Cl.[6] ..... E05D 15/26

[52] U.S. Cl. ..... 160/183; 160/199

[58] Field of Search ..... 160/183, 199, 160/113, 114, 118, 206, 201, 186, 187, 196.1, 236, 235, 233

[56] References Cited

U.S. PATENT DOCUMENTS

| | | | |
|---|---|---|---|
| 3,073,382 | 1/1963 | Zimmerman et al. | 160/183 |
| 3,529,651 | 9/1970 | Bender | 160/183 |
| 3,670,797 | 6/1972 | Sassano | 160/183 X |
| 3,989,084 | 11/1976 | Inamura et al. . | |
| 4,343,171 | 8/1982 | Kagawa . | |
| 4,386,645 | 6/1983 | Dever et al. | 160/183 |
| 4,424,850 | 1/1984 | Klein . | |
| 4,428,218 | 1/1984 | LaRocca . | |
| 4,433,714 | 2/1984 | Barber . | |
| 4,519,434 | 5/1985 | Forquer . | |
| 4,601,953 | 7/1986 | Haffer . | |
| 4,723,888 | 2/1988 | Watanabe et al. . | |
| 4,846,243 | 7/1989 | Schneider . | |
| 5,097,883 | 3/1992 | Robinson et al. | 160/183 |
| 5,209,147 | 5/1993 | Hawkins et al. . | |
| 5,210,924 | 5/1993 | Schneider . | |

OTHER PUBLICATIONS

Amax Aluminum Extrusion Products, Inc.—production drawings (specification AF798).

Alumax Extrusions, Inc.—production drawings (specification AF–3131).

Publication of the Aluminum Extruders Council entitled Extrusion Spotlight.

Drawings from a publication entitled The Aluminum Extrusion Manual.

*Primary Examiner*—David M. Purol

*Attorney, Agent, or Firm*—Gifford, Krass, Groh, Sprinkle, Patmore, Anderson & Citkowski

[57] ABSTRACT

A blade member for use in a shutter curtain assembly. The blade member is of a given height and has a top, a bottom, a first edge and a second edge. A first semi-cylindrical interlocking portion extends along the first edge. The first portion includes a pair of inwardly-directed tangs which extend from opposite sides of the semi-cylinder. A second semi-cylindrical interlocking portion extends along the second edge and is sufficiently smaller in diameter than the first portion. A second interlocking portion of a succeeding blade member may be slidably inserted into the first interlocking portion. The second portion includes a pair of outwardly-directed tangs which abuttingly engage the inwardly-directed tangs of the first interlocking portion. A series of blade portions are thus interconnected and form a continuous shutter curtain which is selectively unfolded or retracted.

10 Claims, 2 Drawing Sheets

INTERLOCKING SHUTTER CURTAIN ASSEMBLY

BACKGROUND OF THE INVENTION

1. Field of the Invention

The present invention relates generally to shutter assemblies and, more particularly, to a shutter curtain assembly having interlocking blade portions which are movable between folded and unfolded positions to cover an opening.

2. Description of the Prior Art

Various shutter assemblies are known in the art. Such assemblies are normally constructed of linking members which, when a number of members are assembled, form a continuous curtain for covering a garage or other entrance area.

U.S. Pat. No. 4,519,434, issued to Forquer, teaches a winding mechanism for a rollable shutter curtain. A plurality of linking members are provided which wrap around a central tubular drum portion. A plurality of spaced apart arms project from the tubular drum and one of the arms acts as a first of the linking members so that the linking members may be wound or unwound from the drum by a crank or by powered means.

U.S. Pat. No. 3,989,084, issued to Inamura et al., teaches a rolling shutter for a building entrance or a window. The shutter is constructed of a number of elongated slats arranged vertically in a partially overlapping relationship. Pivot pins are located at the lower ends of the slats and are acted upon by actuating means to sequentially pivot the slats from an opening to a closing position.

The shortcoming of the prior art is that it does not teach a shutter construction having interlocking members which are foldable against each other and which are capable of withstanding the force of high winds and the impact forces from objects which are hurtled at high speeds by such winds, especially in hurricane zones.

SUMMARY OF THE PRESENT INVENTION

The present invention is a shutter curtain assembly for use in hurricane and high wind zones. A number of interlocking shutter blade portions are provided, with each blade portion having a first interlocking portion and a second interlocking portion which are separated by a substantially flat central portion. Each of the blade portions has a length equal to the height of an aperture to be covered, such as a window opening or a vehicle entrance. The first interlocking portion projects from the flat central portion the length of the blade and is a curved semicylindrical shape defining a hollow interior. A pair of inwardly directed tangs project from opposite sides of the semicylinder.

The second interlocking portion of each blade portion is also of a curved semicylindrical shape similar in shape to the first interlocking portion but smaller in diameter. The second interlocking portion of a succeeding blade portion is coaxially insertable within the hollowed interior of the first interlocking portion of an initial blade portion. Each of the second interlocking portions has outwardly projecting tangs at opposite ends thereof which engage the inwardly projecting tangs of the first interlocking portions when the succeeding blade portion is pivoted to a certain angle relative to the initial blade portion. The second interlocking portion of each blade portion extends at an offset angle with respect to the flat central portion and is received within the interlocking first interlocking portion of the succeeding blade portion such that the interlocking portions form a substantially accordian shape when the shutter assembly is in an extended or unfolded position.

The interlocking blade portions are pivoted against one another manually or by powered means to move the assembly from the unfolded position to a folded and retracted position. The pivoting of the assembly causes the second interlocking portions of the respective blade portions to rotate within the first interlocking portions until the outwardly projecting tangs of the inner second interlocking portions engage the inwardly projecting tangs of the outer first interlocking portions.

Appropriate guides are provided along the top and bottom of the shutter assembly and receive the top and bottom ends of the blade portions so as to restrain the travel of the assembly to within the guides. A central elongated member may extend along the height of the aperture to be covered and includes a first blade portion extending in one direction and a second blade portion extending in an opposite direction. The elongated member may further include a keylock portion for locking the shutter assembly in place in the extended position.

BRIEF DESCRIPTION OF THE DRAWING

Reference will now be made to the attached drawings, when read in combination with the following specification, wherein like reference numerals refer to like parts throughout the several views, and in which.

DESCRIPTION OF THE PREFERRED EMBODIMENT

Figure 1:
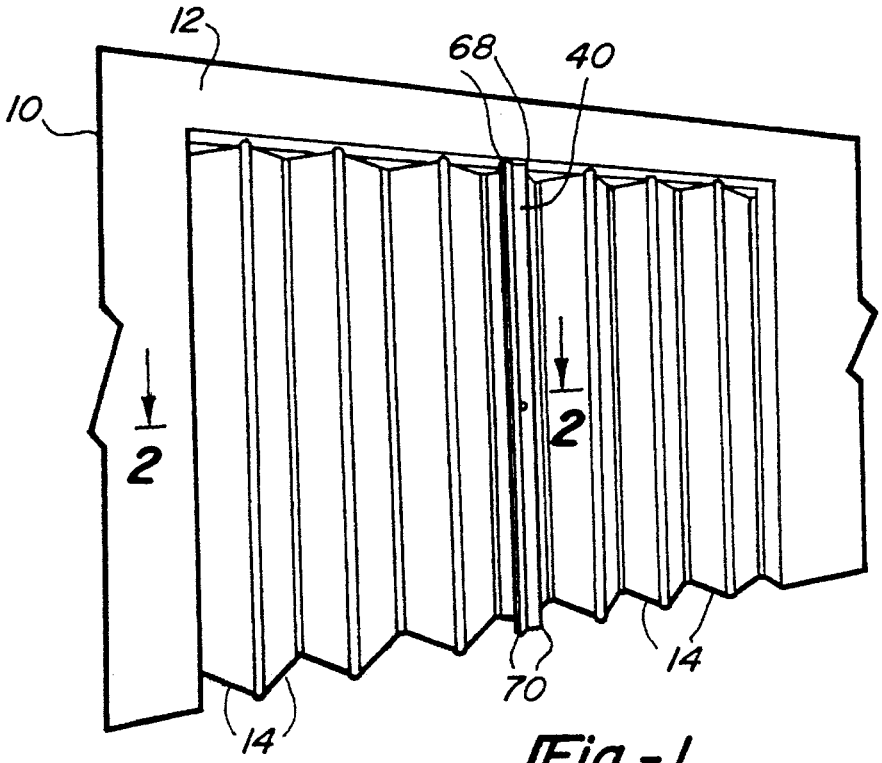
FIG. 1 is a perspective view of the interlocking shutter curtain assembly according to the present invention.

Referring to FIG. 1, a shutter curtain assembly 10 according to the present invention is shown. The shutter curtain assembly 10 is used to cover a garage, doorway, window or any similar opening which is defined by a rectangular or square frame 12 forming an interior aperture. The shutter curtain assembly is made up of a plurality of individual blade portions 14 which are interlockingly connected. The connected blade portions 14 form a substantially accordian shape when they are drawn across the framed opening. The blade portions 14 each have a length equal to the height of the opening to be covered and when connected together extend across the width of the opening. The blade portions 14 are preferably constructed of a high strength tempered aluminum alloy, however they can also be constructed of any other desirable metal or polymer exhibiting the necessary characteristics of strength and durability.

Figure 4:
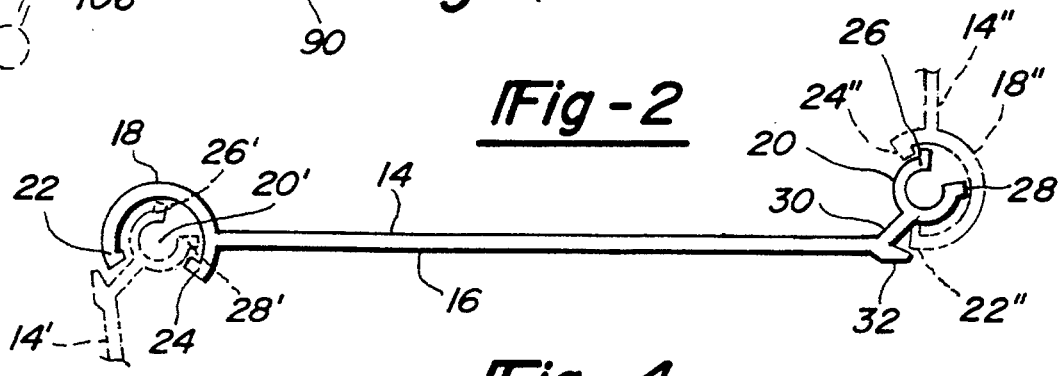
FIG. 4 is a view of an individual blade portion of the shutter curtain assembly according to the present invention and illustrating in phantom the connection to opposite succeeding blade portions.

Referring further to FIG. 4, an individual blade portion 14 is shown in cross section. The blade portion 14 includes a flat central portion 16 to which is attached a first interlocking portion 18 and a second interlocking portion 20. The first interlocking portion 18, the second interlocking portion 20 and the flat central portion 16 extend the entire length of the shutter blade from the top of the framed opening 12 to the bottom as shown in FIG. 1.

The first interlocking portion 18 is defined by a substantially semicylindrical-shaped portion which extends from the flat central portion the length of the blade. The first portion 18 encompasses an angle that is actually slightly greater than a 180 degree semi-cylinder. The semi-cylinder forms a hollow interior between opposing edges with a given inner diameter. A first inwardly-directed tang 22 projects from one of the edges of the semi-cylinder and a second inwardly-directed tang 24 projects from the other edge of the semi-cylinder. The inwardly-directed tangs 22 and 24 extend the entire length of the blade and create opposite and abutting surfaces within the semicylindrical opening of the first interlocking portion. The tang 22 is a pointed, inwardly-directed portion while the tang 24 forms a more pronounced and inwardly-directed dog leg.

The second interlocking portion 20 is defined by a substantially semicylindrical-shaped portion which extends from the flat central portion opposite the first interlocking portion and the length of the blade. The second interlocking portion 20 is shaped similarly to the first interlocking portion 18, but is smaller in diameter. Similarly to the first interlocking portion, the second interlocking portion forms an angle that is actually slightly greater than a semi-cylinder and has a hollow interior between opposing edges.

A first tang 26 projects outwardly from one of the edges of the semi-cylinder 20 and a second tang 28 projects outwardly along the other edge of the semi-cylinder. The outwardly-directed tang 26 is pointed similar to the inwardly-directed tang 22, while the outwardly-directed tang 28 forms a dog leg similar to the inwardly-directed tang 24.

The second interlocking portion 20 includes a leg 30 which is angled relative to the flat central portion 16 of the blade and which offsets the second interlocking portion 20 from the axis of the central portion 16. A reinforcing portion or flange 32 extends from the connection between the leg 30 and the flat central portion 16 on a side opposite the leg and acts to strengthen the connection between the second interlocking portion and the blade.

Figure 2:
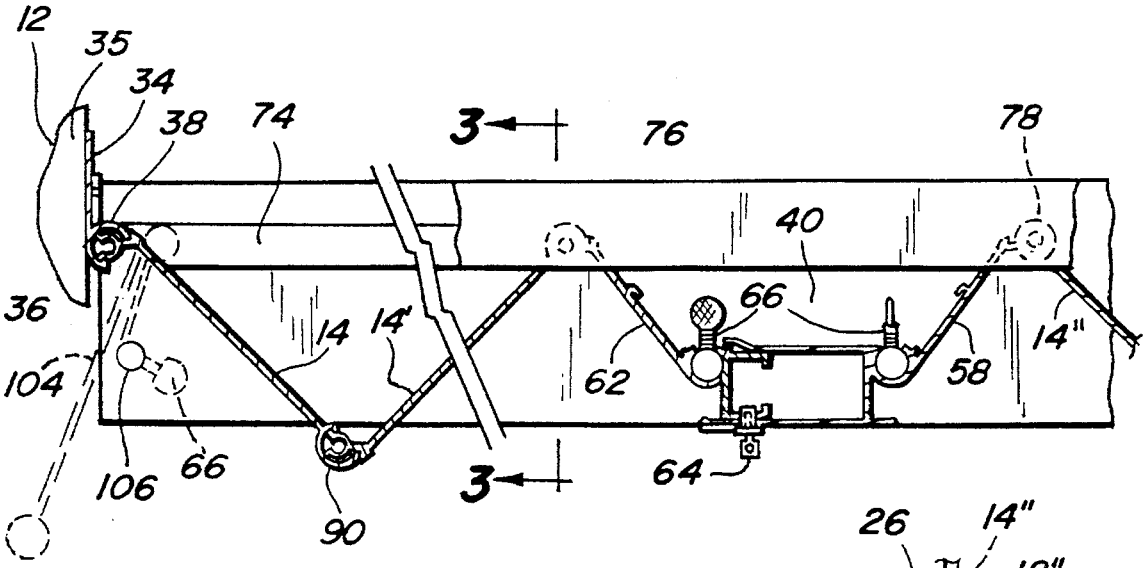
FIG. 2 is a cutaway view taken along line 2—2 of FIG. 1 and showing the interlocking arrangement of the shutter blade portions according to the present invention.

As can best be seen in FIG. 4, the flange 32 is in abutting contact with the tang 22" of the first interlocking portion 18 when the shutter blades 14 are pivoted to the expanded position shown in FIG. 2.

Referring again to FIG. 4, the connection between the blade portion 14 and succeeding blade portions 14' and 14" is shown. As will be further described in subsequent description of the invention, a plurality of blade portions are interlockingly connected to form a substantially accordian-shaped shutter assembly. A first subsequent blade portion 14' is shown in phantom and includes a second interlocking portion 20' having outwardly-directed tangs 26' and 28'. The second interlocking portion 20' is slidingly inserted within corresponding first interlocking portion 18 of blade portion 14 the length of the blade portion 14. The smaller diameter semi-cylinder and the outwardly-directed tangs of the second interlocking portion 20' are coaxially encapsulated within the hollow interior of the first interlocking portion 18. A predetermined range of pivotal movement is permitted between the blade 14' and the blade 14 until one of the inwardly-directed tangs 22 and 24 of the first interlocking portion 18 engage the outwardly-directed tangs 26' and 28' of the second interlocking portion 20, at which point the blade 14' is at a maximum pivotal position relative to the blade 14.

Similarly, the opposite second interlocking portion 20 of blade 14 is slidably inserted within a corresponding first interlocking portion 18" of blade 14", indicated in phantom. The inwardly-directed tangs 22" and 24" of the interlocking portion 18" encircle the outwardly-directed tangs 26 and 28 of the interlocking portion 20. The pivotal travel of the blade 14" relative to the blade 14 is limited to the same degree as that of the blade 14' relative to the blade 14. The oppositely-facing pairs of tangs of the respective first interlocking portions and second interlocking portions maintain the blades in interlocking engagement and allow the necessary range of pivotal motion to open and close the shutter curtain assembly.

Referring to FIG. 2, a cutaway view of the shutter curtain assembly is displayed which shows the interlocking blade portions as previously described in FIG. 4. The shutter curtain is shown in a preferred embodiment in which it extends to cover an opening from opposite sides of the frame 12 which defines the opening. It should also be understood that a single shutter curtain can extend all the way across an opening to cover the opening.

A mounting bracket 34 is attached to side 35 of the frame 12 by any means known in the art. Specifically, a mounting screw 36 for piercing wood or concrete masonry can be employed to mount the bracket 34. The bracket includes a first, or outer, interlocking portion 38 identical in all respects to the first interlocking portion 18 described in FIG. 4. The second, or inner, interlocking portion of a blade 14 is slidably engaged within the interlocking portion 18 of the bracket 34. A succeeding blade 14' is mounted to the end of the first blade 14 as previously described.

Figure 5:
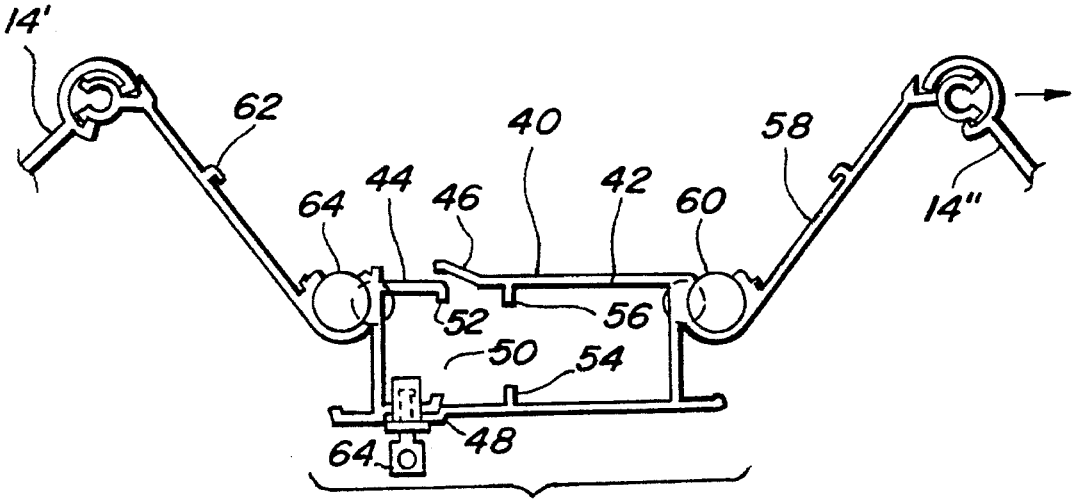
FIG. 5 is a sectional view similar to FIG. 2 and showing the central elongated member with first and second blade portions extending in opposite directions.

Referring again to FIG. 2, and further to FIG. 5, an elongated member 40 extends the height of the framed aperture at a point midway between the opposite sides of the aperture. The member 40 is separated into a first engaging portion 42 and a second engaging portion 44. The first engaging portion 42 is substantially rectangular in shape and terminates in an outwardly flared first edge 46 and an outwardly flared second edge 48. The second engaging portion 44 is much smaller in size than the first engaging portion 42 and terminates in an edge 50 and an edge 52. The edges 50 and 52 are inwardly pointed and abut against inwardly-directed portions 54 and 56 extending from the edges 46 and 48 of the first engaging portion 42 when the second engaging portion is slidingly locked into place within the first engaging portion.

A blade portion 58 similar in all respects to the blade portions previously described is formed as one piece at 60, with the first engaging portion 42. Similarly, a blade portion 62 is likewise attached to an opposing end of the second engaging portion 44, at 64. A normal blade portion 14" attaches to a second, or inner, interlocking portion of the blade 58 and a likewise normal blade portion 14' attaches to a second interlocking portion of the blade 62 as previously described.

A key and lock assembly 64 may be positioned at the overlapping first and second engaging portions of the elongated member and enables the user to lock the shutter assembly in place in an unfolded position.

Referring again to FIG. 2, a pair of upper locking pins 66 are provided and are inserted within the semicylindrical channels of the first interlocking portions of blade portions 58 and 62 at their connection to the engaging portions 42 and 44. The locking pins 66 each include a perpendicular and threadably engaged screw portion which is rotatable within the pins and fixes the pins in position with respect to the cylindrical channels of the first connecting portions. Apertures are formed into the surrounding frame 12 at 68, shown in FIG. 1, and receive the pins 66 to lock the engaging portions 42 and 44 in position to the frame once they are snappingly engaged together. An identical pair of pins 66 is preferably provided at the bottom of the engaging portions 42 and 44 and locks them into place along the lower surface of the framed aperture by engaging within another pair of apertures 70 formed within the bottom of the frame.

Figure 3:
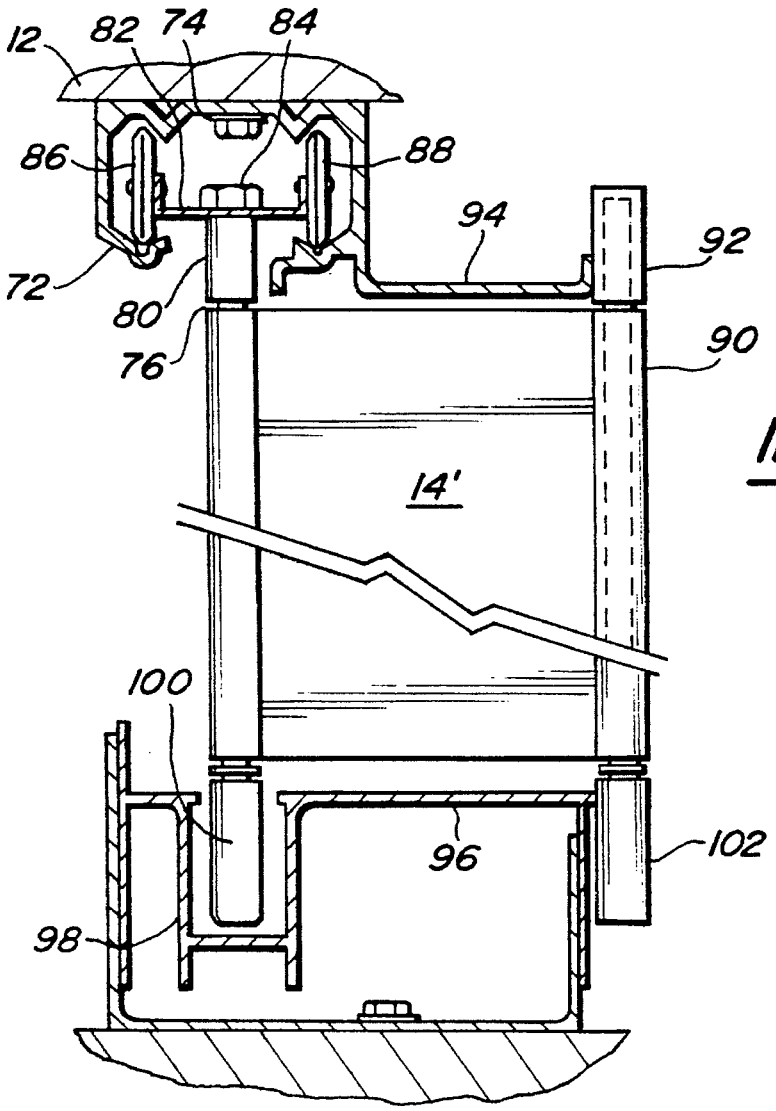
FIG. 3 is a cutaway view taken along line 3—3 of FIG. 2 and showing the guide roller arrangement for the shutter assembly of the present invention.

Referring to FIG. 3, a side cutaway view of the shutter curtain assembly is shown. A guide assembly 72 defining a channel 74 extends from one side of the aperture to the other side of the aperture. The guide assembly 72 permits the opposing halves of the shutter curtain to be drawn back to the sides of the frame when it is desired to open the shutter.

Referring again to FIG. 2, a connection 76 and a connection 78 between respective first and second blade interlocking portions is shown. Specifically, connection 76 interlocks blades 14' and 62 and connection 78 interlocks blades 14 and 58. These connections are the same as described in interlocking blade portions of FIG. 4 and allow the blades to pivot relative to each other for a given degree until opposing tangs of the first and second interlocking portions come into abutting contact.

Referring again to FIG. 3, a mounting portion 80 extends from the connection 76 upwardly past the upper edge of the respective blades 14' and 62. A bracket 82 is attached by a bolt 84 across the top of the mounting portion 80. A first roller 86 and a second roller 88 extend from opposite sides of the bracket 82 and are restrained to travel within grooves formed within the guide assembly 72. The first roller 86 and second roller 88 are preferably attached to the bracket 82 by screws, rivets or welding as is commonly known in the art. An outer connection 90 is shown between the blades 14 and 14' and is guided during travel of the shutter curtain along a forward portion 92 of the guide assembly 72 by a flange 94 which supports the forward portion 92.

The weight of the shutter curtain is entirely supported by the upper guide assembly 72 and a lower guide plate 96 is attached along the lower edge of the frame to guide the lower edges of the shutter assembly. Specifically, the lower guide plate 96 is shaped as an interior channel at 98 to guide a corresponding lower portion 100 of the connection 78 between the blades 14 and 14'. A similar extending portion 102 of the connection 90 is guided along the front of the lower guide plate 96. The side view of FIG. 3 only shows the mounting of connection 76 within the guide assembly, however connection 78 is identically mounted within the guide assembly.

In operation, the shutter curtain assembly is normally in an unfolded and covered position as shown in FIG. 1. In order to open the shutter assembly, the upper and lower pairs of locking pins 66 secured within the engaging portions 42 and 44 are loosened and slided out of the apertures 68 and 70 formed in the upper and lower edges of the frame and extending the height of the frame at its most central point. The keylock assembly 64 is then unlocked so that the engaging portion 42 can be separated from the engaging portion 44. The half of the shutter curtain extending from the engaging portion 42 is drawn back toward one side of the frame while the half of the shutter curtain extending from the engaging portion 44 is drawn back toward the other side of the frame.

The guide assembly extending along the top of the frame enables the shutter curtain halves to be easily separated and moved to the opposite sides of the frame. The blade portions pivot at their respective interlocking connections to the degree allowed by the oppositely facing tangs until the blade portions are substantially folded against each other. Referring again to FIG. 2, a representation 104 is shown in phantom of the folded blades 14, 14' and 62. A lower aperture 106 similar to the lower apertures 70 is formed near the edge of the bottom of the frame and receives the lower pin 66 to secure the folded shutter to the side of the frame. A similar aperture is formed along each edge at the top and bottom of the frame to secure the retracted shutters in place.

In this fashion, a shutter curtain assembly constructed of a plurality of individual shutter blade portions may be used to cover a framed aperture even in the face of heavy winds and inevitable impact of objects hurtled at high velocities by such winds. Specifically, the construction of the blade portions with the pivotal and interlocking outer and inner portions can withstand impact forces greatly in excess of previous shutter constructions. Also, the accordian-like shape of the shutter construction causes the impact forces of objects to be partially deflected and more evenly distributed across the length of the construction.

Having described my invention, additional embodiments will become apparent to those skilled in the art to which it pertains without deviating from the scope of the appended claims.

I claim:

1. A shutter blade construction for use in an interlocking shutter curtain assembly, comprising:

at least one shutter blade having a body constructed of a member having a central elongated portion with a top, a bottom, a first edge and a second edge;

a first interlocking portion extending from said central portion along said first edge of said body;

a second interlocking portion extending from said central portion along said second edge of said body;

a leg extending between said central portion and said second interlocking portion and an elongated flange extending outwardly from said member adjacent the connection between said leg and said central portion; and means for attaching a first interlocking portion of a first shutter blade to a second interlocking portion of an identical second shutter blade so that said second shutter blade is pivotally mounted with respect to said first shutter blade and said flange is in an abutting contact with said first interlocking portion when said shutter blades are pivoted from a first folded position to a second unfolded position.

2. The shutter blade construction according to claim 1, wherein said first interlocking portion is semi-cylindrical in shape with a hollow interior defining an inner diameter.

3. The shutter blade construction according to claim 2, wherein said second interlocking portion is a semi-cylinder having an outer diameter less than said inner diameter of said first interlocking portion

4. The shutter blade construction according to claim 3, wherein said means for attaching comprises coaxially inserting said second interlocking portion within said first interlocking portion.

5. The shutter blade construction according to claim 4, wherein said means for attaching further comprises:

a first pair of inwardly-directed tangs extending from opposite ends of said first interlocking portion;

a second pair of outwardly-directed tangs extending from opposite ends of said second interlocking portion;

wherein a given outwardly-directed tang of said second interlocking portion engages an opposed inwardly-directed tang of said first interlocking portion upon a given pivotal rotation of said second shutter blade with respect to said first shutter blade.

6. The shutter blade construction according to claim 1, further comprising a plurality of shutter blades interlockingly engaged and extending across a framed aperture.

7. The shutter blade construction according to claim 6, further comprising an engaging member extending a height of the framed aperture at a substantially central point within the aperture, the engaging member separating into a first engaging portion and a second engaging portion which divides the shutter curtain into a first shutter half and a second shutter half.

8. The shutter blade construction according to claim 7, further comprising a guide roller assembly for retracting the first shutter curtain half and the second shutter curtain half to opposite sides of the framed aperture.

9. The shutter blade construction according to claim 8, further comprising a set of pins for locking the shutter curtain halves to the frame in either a first extended position or a second retracted position.

10. The shutter blade construction according to claim 7, further comprising a keylock assembly for locking said first engaging portion to said second engaging portion.

* * * * *

US005458179C1

(12) EX PARTE REEXAMINATION CERTIFICATE (4877th)

United States Patent

Magaldi et al.

(10) Number: US 5,458,179 C1

(45) Certificate Issued: Nov. 11, 2003

(54) INTERLOCKING SHUTTER CURTAIN ASSEMBLY

(75) Inventors: Glen Magaldi, Lake Worth, FL (US); Gregory Weeks, Lake Worth, FL (US)

(73) Assignee: Easco Corporation, Girard, OH (US)

Reexamination Request:
No. 90/005,752, Jun. 19, 2000

Reexamination Certificate for:

| | |
|---|---|
| Patent No.: | **5,458,179** |
| Issued: | **Oct. 17, 1995** |
| Appl. No.: | **08/298,216** |
| Filed: | **Aug. 29, 1994** |

(51) Int. Cl.[7] ..... E05D 15/26

(52) U.S. Cl. ..... 160/183; 160/199

(58) Field of Search ..... 160/183, 199, 160/113, 114, 118, 206, 201, 186, 187, 196.1, 236, 235, 233

(56) References Cited

U.S. PATENT DOCUMENTS 3,670,797 A 6/1972 Sassano
5,097,883 A * 3/1992 Robinson et al. ..... 160/183

OTHER PUBLICATIONS

Alumax Extrusions, Inc.—Production drawings (specification AF–).*
Amax Aluminum Extrusion Products, Inc.—Production drawings (specification AF798).
Alumax Extrusions, Inc.—Production drawings (specification AF–3131.
Publications of the Aluminum Extruders Council entitled Extrusion Spotlight.
Drawings from a publication entitled The Aluminum Extrusion Manual.

* cited by examiner

*Primary Examiner*—David Purol

(57) ABSTRACT

A blade member for use in a shutter curtain assembly. The blade member is of a given height and has a top, a bottom, a first edge and a second edge. A first semi-cylindrical interlocking portion extends along the first edge. The first portion includes a pair of inwardly-directed tangs which extend from opposite sides of the semi-cylinder. A second semi-cylindrical interlocking portion extends along the second edge and is sufficiently smaller in diameter than the first portion. A second interlocking portion of a succeeding blade member may be slidably inserted into the first interlocking portion. The second portion includes a pair of outwardly-directed tangs which abuttingly engage the inwardly-directed tangs of the first interlocking portion. A series of blade portions are thus interconnected and form a continuous shutter curtain which is selectively unfolded or retracted.

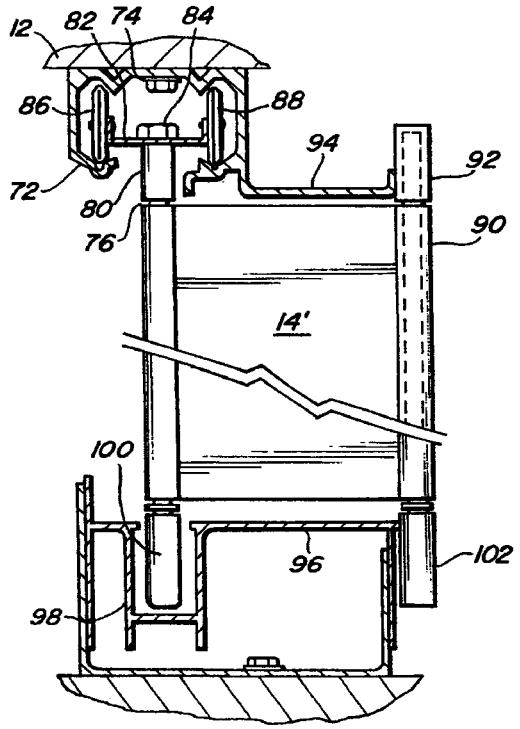

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 6 is cancelled.

Claims 1 and 7 are determined to be patentable as amended.

Claims 2–5 and 8–10, dependent on an amended claim, are determined to be patentable.

1. A shutter blade construction for use in an interlocking shutter curtain assembly, *for withstanding high winds as well as forces generated by impacting objects, said shutter blade construction* comprising:

at least one shutter blade having a body constructed of a member having a central elongated portion with a top, a bottom, a first edge and a second edge;

a first interlocking portion extending from said central portion along said first edge of said body;

a second interlocking portion extending from said central portion along said second edge of said body;

a leg extending between said central portion and said second interlocking portion and an elongated flange extending outwardly from said member adjacent the connection between said leg and said central portion; and means for attaching a first interlocking portion of a first shutter blade to a second interlocking portion of an identical second shutter blade so that said second shutter blade is pivotally mounted with respect to said first shutter blade and said flange is in an abutting contact with said first interlocking portion when said shutter blades are pivoted from a first folded position to a second unfolded *and expanded* position, *a plurality of shutter blades interlockingly engaging and extending across a frame aperture*.

7. The shutter blade construction according to claim [6] *1*, further comprising an engaging member extending a height of the framed aperture at a substantially central point within the aperture, the engaging member separating into a first engaging portion and a second engaging portion which divides the shutter curtain into a first shutter half and a second shutter half.

* * * * *